US007453696B2

(12) United States Patent
Tungl et al.

(10) Patent No.: US 7,453,696 B2
(45) Date of Patent: Nov. 18, 2008

(54) COOLING DEVICE FOR A RADIAL FAN DRIVEN BY AN ELECTRIC MOTOR WITH IC

(75) Inventors: Rudolf Tungl, Ergolding (DE); Roland Keber, Wörth a.d. Isar (DE)

(73) Assignee: ebm-papst Landshut GmbH, Landshut (DE)

( * ) Notice: Subject to any disclaimer, the term of this patent is extended or adjusted under 35 U.S.C. 154(b) by 65 days.

(21) Appl. No.: 11/374,616

(22) Filed: Mar. 13, 2006

(65) Prior Publication Data

US 2006/0202572 A1 Sep. 14, 2006

(30) Foreign Application Priority Data

Mar. 14, 2005 (DE) ..... 20 2005 004 274 U

(51) Int. Cl.
*H05K 7/20* (2006.01)
*F04B 39/02* (2006.01)
*F04B 17/00* (2006.01)

(52) U.S. Cl. ..... 361/695; 361/719; 415/175; 417/423.1

(58) Field of Classification Search ..... 361/694–695
See application file for complete search history.

(56) References Cited

U.S. PATENT DOCUMENTS

| | | | | |
|---|---|---|---|---|
| 4,164,690 | A | 8/1979 | Muller et al. | |
| 5,008,573 | A * | 4/1991 | Beppu et al. | 310/67 R |
| 5,925,948 | A | 7/1999 | Matsumoto | |
| 6,021,043 | A * | 2/2000 | Horng | 361/695 |
| 6,109,890 | A | 8/2000 | Horng | |
| 6,219,236 | B1 * | 4/2001 | Hirano et al. | 361/695 |
| 6,951,449 | B2 * | 10/2005 | Huang et al. | 417/368 |
| 7,154,750 | B2 * | 12/2006 | Li et al. | 361/695 |

FOREIGN PATENT DOCUMENTS

| | | |
|---|---|---|
| DE | 195 46 040 | 6/1996 |
| DE | 100 44 066 | 4/2002 |
| DE | 102 04 037 | 8/2003 |
| EP | 0 221 459 | 5/1987 |

* cited by examiner

*Primary Examiner*—Gregory D Thompson
(74) *Attorney, Agent, or Firm*—Harness, Dickey & Pierce, PLC

(57) ABSTRACT

A radial fan includes an integrated circuit which is conductively connected to a printed circuit board to control a motor. The flow of air provided by a cooling impeller is conveyed directly to the integrated circuit to cool the integrated circuit during operation of the radial fan.

15 Claims, 4 Drawing Sheets

COOLING DEVICE FOR A RADIAL FAN DRIVEN BY AN ELECTRIC MOTOR WITH IC

CROSS REFERENCE TO RELATED APPLICATIONS

This application claims the priority of German Utility model application Serial No. 20 2005 004 274.9 filed Mar. 14, 2005, the subject matter of which is incorporated herein by reference.

BACKGROUND

A generic radial fan is known from DE 102 04 037 A1 which has a fan housing with a rotating fan impeller therein and with a respective intake and outlet opening. The fan impeller is connected to the electric motor by a drive shaft. The electric motor is covered by a cup-shaped cap. Disposed inside the cap is a printed circuit board with electronic components. An air impeller for cooling the electric motor and the electronic components disposed on the printed circuit board is driven by the electric motor.

The volume of flow conveyed by means of the known radial fan is set by the number of revolutions of the electric motor. The electronic components, which are disposed on the printed circuit board inside the cap, are used for this purpose.

Meanwhile, the step is taken to combine a large number of electronic components for control of the electric motor into an integrated circuit (IC), also called a chip. It is problematic here that the amount of heat that develops due to the dissipation loss in the IC being used is relatively high. In order to cool the IC it is known to use metal cooling elements. Without this type of forced cooling, the IC would very quickly heat up to inadmissibly high temperatures and be turned off by a protective circuit by means of which the fan would also be put out of operation. So that the heat absorbed by the cooling elements can be returned to the environment, the cooling elements are often attached to the outside of the housing. The size of the cooling elements used has a negative effect upon the installation height of the radial fan.

SUMMARY

It is the object of the invention is to provide a radial fan of the generic type which is characterised by a low fault liability and a small installation height of the radial fan while having low production costs.

This object is fulfilled with the object of claim 1. According to the invention, provision is made such that an integrated circuit (IC or chip) is conductively connected to the printed circuit board for control of the motor, and that the flow of air produced by the cooling impeller is conveyed specifically to the IC. Due to the embodiment according to the invention, the radial fan gets by without any additional cooling elements for the IC, and this has a positive effect upon the installation height.

The basic idea behind the invention is to specifically guide a flow of air produced by the air impeller, and so guarantee effective cooling of electronic components, in particular the IC, subjected to high thermal loads. The air flows produced by the air impeller are not only to be understood here as being the partial air flows blown directly by the air impeller, but also the air flows taken in. In order to guide one or more (partial) air flows, as described below, a separate air flow guiding device is provided with which the air flow or flows is/are conveyed directly to the IC or past the same. In addition or alternatively, it is also possible to alter the existing architecture of the radial fan by small changes with regard to optimal cooling of the components. In particular at this point, the possibility of making a flow through opening in the conductor plate which is already available is mentioned, through which a (partial) air flow is conveyed directly in the direction of the IC.

An arrangement of the printed circuit board, the preferably cup-shaped cap and the electric motor relative to one another, which is known in its own right and saves space, should be maintained in the embodiment of the invention. Provision is made here such that the printed circuit board has an upper side facing towards the cover of the cap and an opposite lower side, and that the printed circuit board is disposed substantially parallel to the cover of the cap and orthogonally to the drive shaft of the electric motor, and that the air impeller is disposed between the electric motor and the cover of the cap. Advantageously, the air impeller is in the form of a radial fan. By means of this design, cool external air can be taken in axially, and dispersed radially, in particular parallel to the printed circuit board.

As already mentioned at the start, it is already surprisingly possible by means of small alterations to the architecture, to make improvements to the cooling. Advantageously, for example, a flow through opening can be provided in the printed circuit board and the IC can be disposed adjacent to this flow through opening. A (partial) air flow then flows through the flow through opening directly to the IC.

The cooling effect can be further improved by disposing the IC within the (partial) air flow flowing through the flow through opening. For this, the IC can for example be disposed a distance away from the printed circuit board on a support which is at an angle, in particular of between 90° and 10°, to the printed circuit board. Provision can be made such that the support is flexible in form so as to be able to vary the position of the IC relative to the flow through opening.

According to an advantageous further development of the invention, the IC is disposed on the lower side of the printed circuit board, a distance away from the same. In addition or alternatively, the electronics are disposed on the lower side of the printed circuit board. Due to this inventive step, a (partial) air flow flowing off the air impeller can flow along the upper side of the printed circuit board, without heating, and then flow directly to the IC or past the same, for example through the flow through opening in the printed circuit board. In this way, particularly effective cooling of the IC is guaranteed.

So that the highest possible cooling performance is achieved, it is advantageous if at least one inflow opening for external air is provided in the cap and which is preferably disposed relative to the air impeller such that external air can be prevented from flowing directly along the electronics and/or the IC and/or the electric motor, and associated preheating of this air is avoided before it reaches the air impeller.

This is achieved according to a first embodiment in that the inflow opening is disposed in the cover of the cap, in particular directly adjacent to the air impeller. The intake opening of the air impeller is directed here in the direction of the inflow opening so that mainly, or better exclusively, cool external air is taken in.

A second embodiment makes provision such that the inflow opening is made in the peripheral wall of the cap, preferably adjacent to the IC. In this way, the cool external air can flow along the IC before it reaches the air impeller.

According to an alternative embodiment, the inflow opening is formed by a gap between the cap and the fan housing. This variation has advantages relating to production because no additional opening needs to be made in the cap.

According to the invention, in order to optimise the cooling of the IC, provision is furthermore made such that the electronics and/or the electric motor are disposed such that the external air flowing in through the inflow opening does not flow directly past these components before reaching the IC. This is achieved in particular by providing baffles or deflectors.

A particularly advantageous arrangement is achieved in that a recess is provided in the printed circuit board for the air impeller and that the air impeller is disposed across the printed circuit board so that a (partial) air flow flowing off sweeps along the upper side, and a further (partial) air flow flowing off sweeps along the lower side of the printed circuit board. If no electronics are disposed on the upper side of the printed circuit board, the air flowing along above the printed circuit board, without being heated, can be conveyed directly to the IC. By means of the horizontal flow of air below the printed circuit board, the electronics disposed on the lower side of the printed circuit board are cooled parallel to this.

The cooling of the IC and/or the electronics is improved in that at least one air flow guiding device is provided. In order to reduce assembly costs, this can be formed integrally in the cover of the cap. By means of the air flow guiding device, the cool air flow can for example be diverted from the upper side of the printed circuit board through the flow through opening to the IC. On the lower side of the printed circuit board an air guiding device can be attached which prevents the (partial) air flow flowing along the electronics from flowing to the IC. Deflectors, bars formed integrally with components or channels can for example be used as air guiding devices.

According to one advantageous embodiment of the invention, an inflow opening for the air impeller is provided in the printed circuit board. The air impeller is disposed directly adjacent to this inflow opening, on the lower side of the printed circuit board. The air flow produced is discharged from the air impeller exclusively on the lower side of the printed circuit board. By means of this step, the installation height can be reduced because air guiding devices between the printed circuit board and the cover of the cap can be dispensed with. Furthermore, the shortened impeller which is used has a positive effect upon minimisation of the installation height.

In order to increase the number of revolutions and so the cooling performance of the air impeller, a transmission can be operated between the electric motor and the air impeller.

DRAWINGS

In the following, the invention is described in greater detail with reference to the examples of embodiments shown in the figures. In the Figures:

FIG. 1 shows a schematic sectional illustration of a first embodiment of a radial fan according to the invention;

FIG. 1*a* shows a schematic view corresponding to that of FIG. 1 of a further example of an embodiment;

FIG. 1*b* shows a schematic view of a cap of the fan according to FIG. 1*a* from below;

DETAILED DESCRIPTION

In the Figures, the same components or components with the same function are identified with identical reference numbers.

Figure 1:
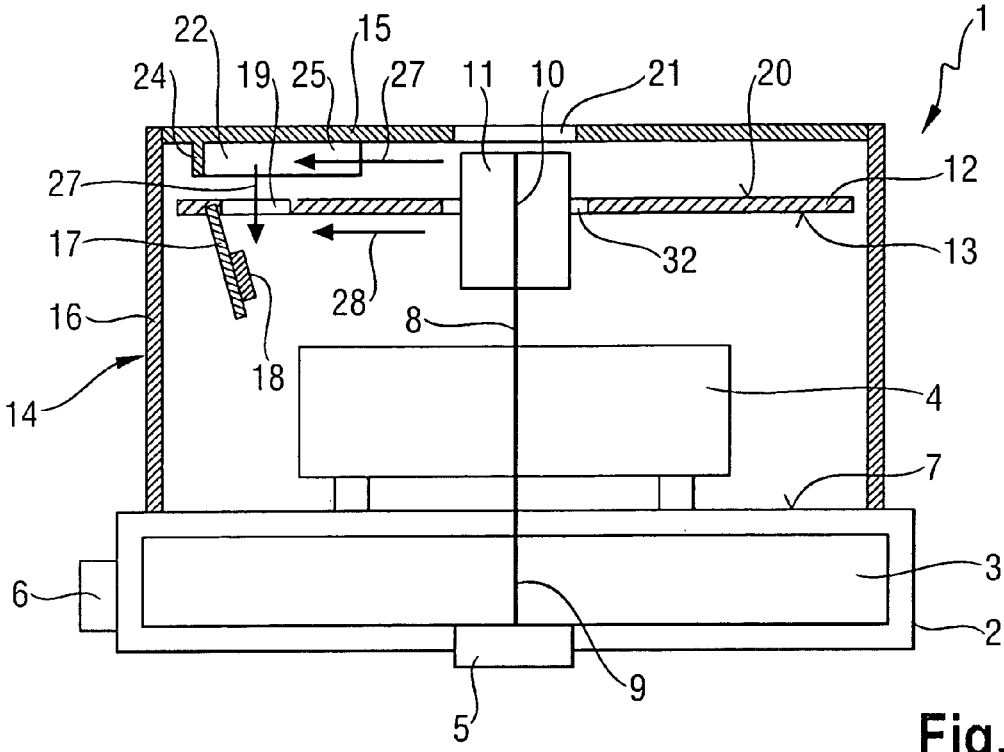

FIG. 1 shows a schematic sectional illustration of a radial fan 1 according to the invention which has a fan housing 2 in the form of a flat cylinder, with a fan impeller 3 rotating therein, and an electric motor 4 driving the fan impeller 3. The fan housing 2 has a central intake opening 5 and a side outlet opening 6.

This type of radial fan is used to convey a gas/air mixture for a gas heat source, for a gas burner or similar.

The electric motor 4 is mounted on the side 7 of the fan housing 2 opposite the intake opening 5. It has a continuous drive shaft 8 which projects into the fan housing 2 and which at its one end region 9 is connected to the fan impeller 3 so as to prevent relative rotation, and at the opposite end region 10 is connected to an air impeller 11 in the form of a radial cooler fan so as to prevent relative rotation. Over the common drive shaft 8, the electric motor 4 drives both the fan impeller 3 and the air impeller 11.

A flat printed circuit board 12 is disposed orthogonally to the drive shaft 8. On the printed circuit board 12 are located the electronics (not shown) which extend exclusively on the lower side 13 of the printed circuit board 12.

The electric motor 4 with the printed circuit board 12 and the air impeller 11 are enclosed by a cup-shaped cap 14. The cup-shaped cap 14 is defined on the front side by a circular cover 15 from which there extends a cylindrical peripheral wall 16 perpendicularly towards the fan housing 2 so that the previously mentioned components are protected from touching. The cap 14 is fixed to the fan housing 3 by means of a screw or snap-on connection (not shown) so that the printed circuit board 12, electric motor 4 and air impeller 11 are enclosed on all sides.

The printed circuit board 12 extends parallel to the cover 15 of the cap 14 so that a space is formed between the cover 15 and the printed circuit board 12.

Attached to the lower side 13 of the printed circuit board 12 there is a support 17 with an integrated circuit (IC) 18 disposed on it. The dissipation loss of the IC is between approximately 3 W to 4 W with a heat resistance of approximately 60 K/W. The support 17 projects downwardly on the drawing plane at an angle of approximately 80° from the printed circuit board 12 so that the IC 18 is a distance away from the printed circuit board 12.

By means of the support 17, the IC 18 is placed directly below the flow through opening 19, i.e., directly in a (partial) air flow flowing through the flow through opening 19 from an upper side 20 of the printed circuit board.

In the printed circuit board 12, a recess 32 is provided for the air impeller 11. The air impeller 11 crosses the recess 32 in the printed circuit board 12 so that the horizontal air flow flowing off from the air impeller 11 is divided into two (partial) air flows 27 and 28, the (partial) air flow 27 flowing along the upper side 20 and the (partial) air flow 28 flowing along the lower side 13 of the printed circuit board 12. Alternatively, the air flow 28 can be dispensed with so that the opening can be correspondingly smaller.

On the drawing plane, an inflow opening 21 for external air is provided directly above the air impeller 11 in the cover 15 of the cap 14. The cool external air is taken in axially from the air impeller 11 and discharged radially in the direction of the arrow.

In order to direct a (partial) air flow specifically towards the IC 18, an air flow guiding device 22 is provided. In this example of an embodiment, the air flow guiding device 22 consists of baffles or guiding walls 23, 24, 25 appropriately designed and integrally formed with the cover 15 of the cap 14 and projecting perpendicularly downwards. The schematically illustrated bars 23, 24, 25 form a cooling channel 26 along with the cover 15 and the printed circuit board 12 which is closed on four sides. The (partial) airflow 27 flows horizontally into this channel 26 and can flow downwards towards the flow through opening 19.

Figure 2:
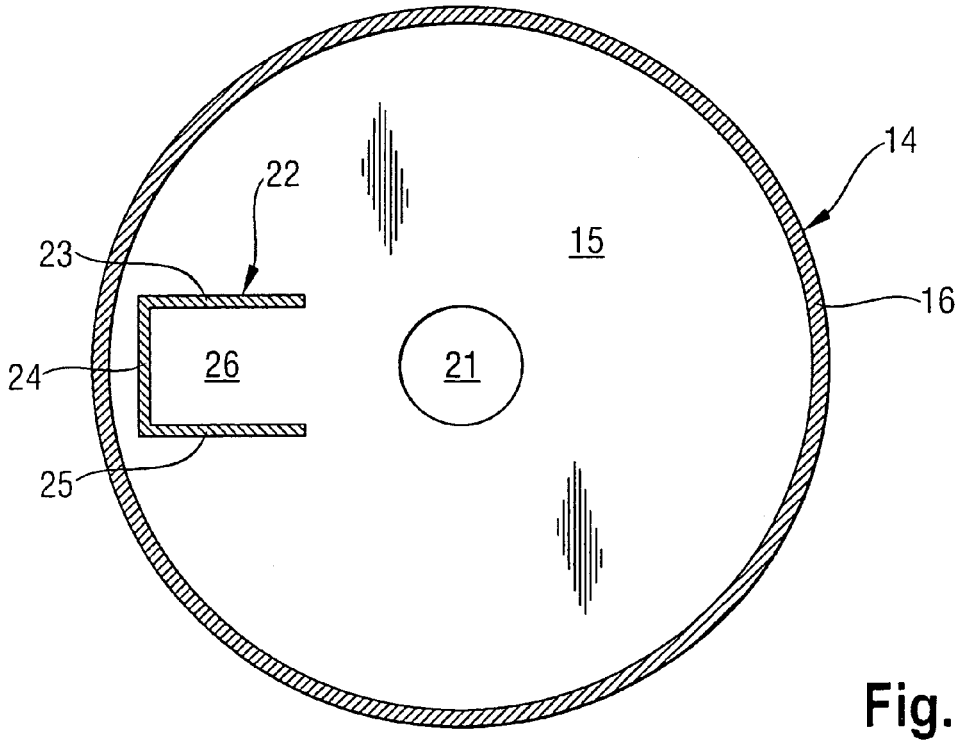
FIG. 2 shows a schematic view of a cap of the fan according to FIG. 1 from below.

In FIG. 2, the cup-shaped cap 14 with the cover 15 is shown in a schematic view from below. The inflow opening 21 is formed in the centre of the cover 15. The air flow guiding device 22 with the cooling channel 26 with the walls 23, 24, 25 extends to the side of the inflow opening 21. It is conceivable for the bars or walls 23, 24, 25 to be extended directly to the flow through opening 19 in the printed circuit board 12 shown in FIG. 1 in order to achieve the best bunched flow possible to the IC 18.

Figure 1A:
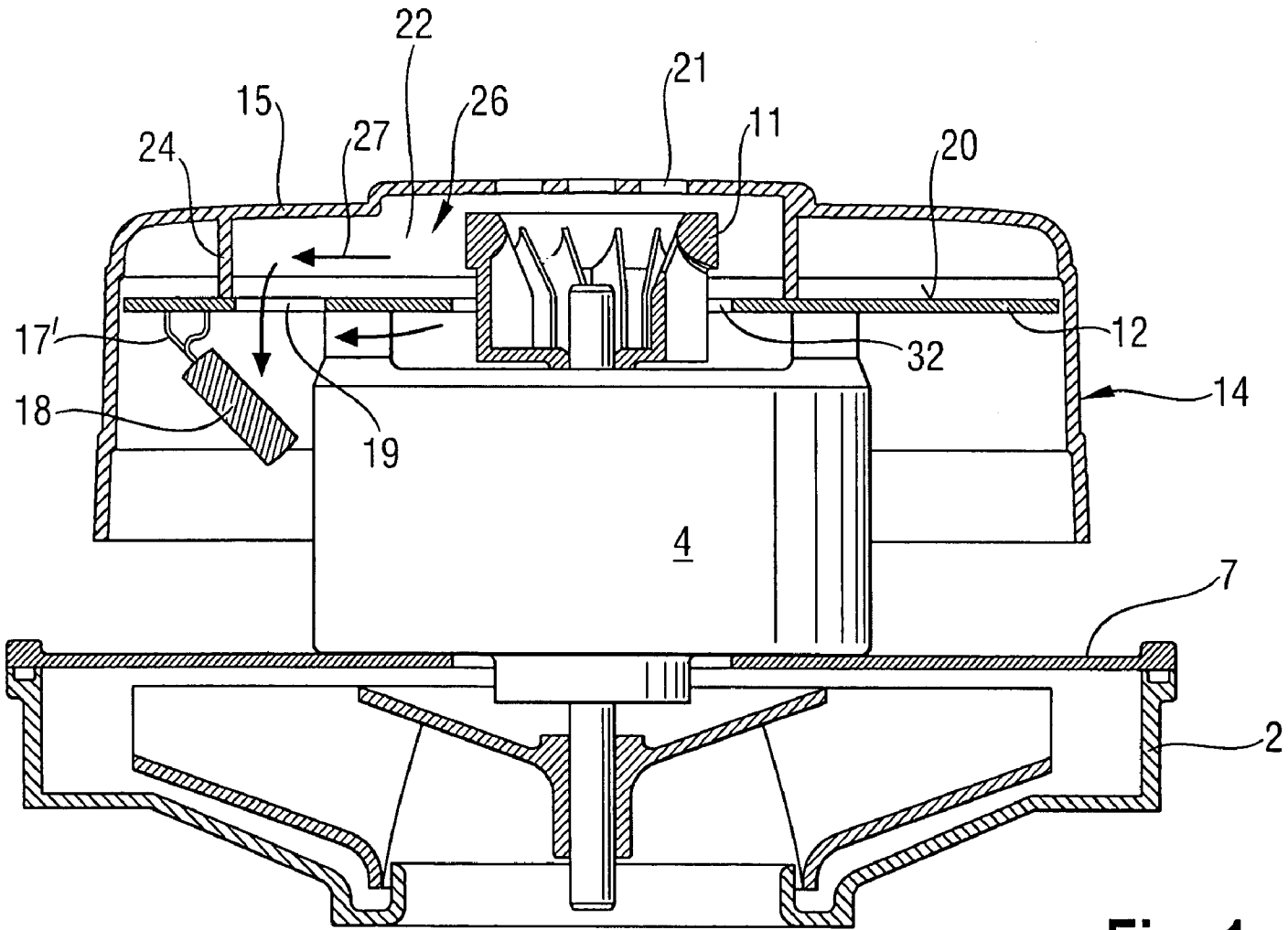
Figure 1B:
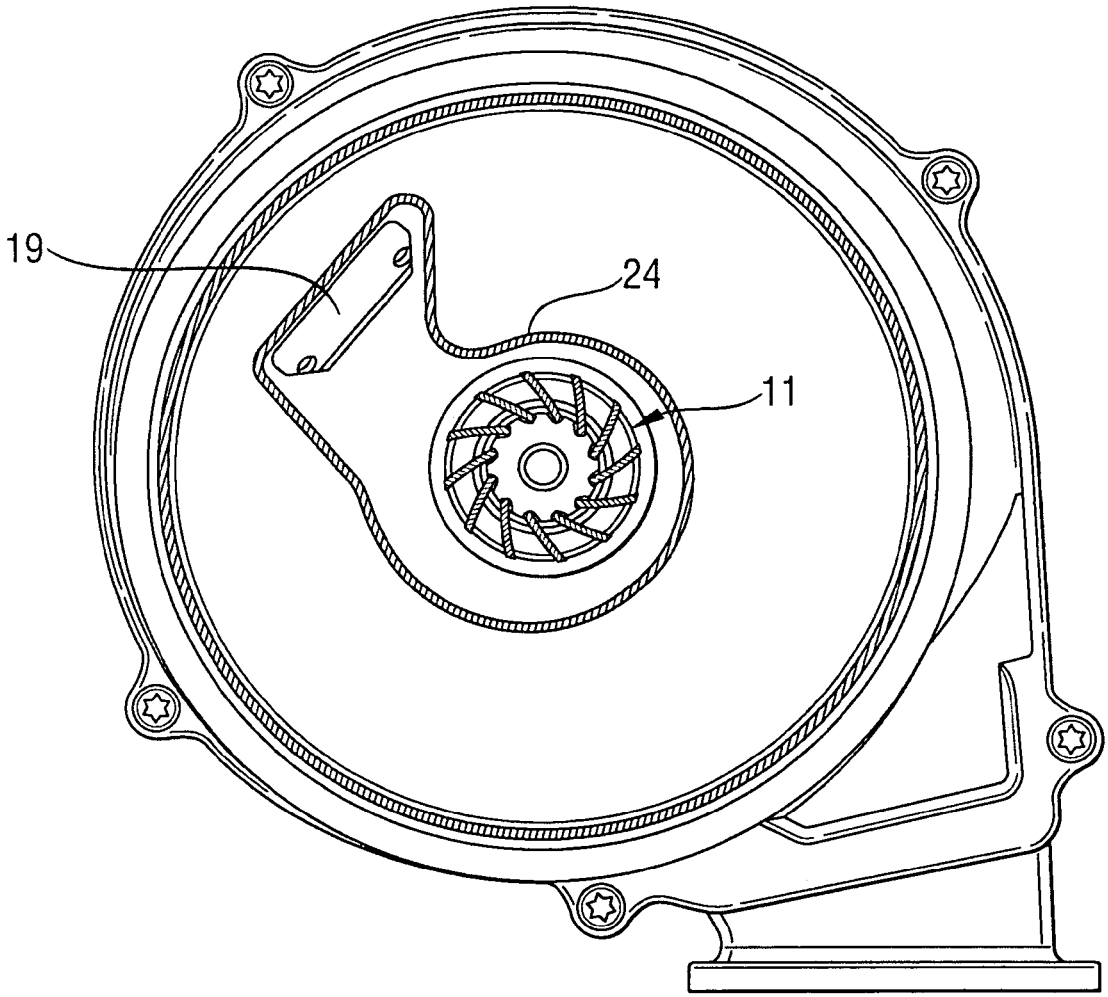

In FIGS. 1*a* and 1*b*, an alternative embodiment is shown. With this, the channel 26 can be in the form of the radial fan housing to the outlet of which the flow through opening 19 is connected. The printed circuit board 20 together with the peripherally closed wall 24 forms the side walls of the spiral housing by means of which the air flow of the radial fan can effectively be directed towards the opening 19.

In the following the (partial) air flows within the cap 14 are described. During operation, the air impeller 11 takes in external air axially through the inflow opening 21 in the cover 15 of the cap 14. Because the inflow opening 21 is disposed directly adjacent to the air impeller 11, the external air flows directly into the air impeller 11 without flowing along the electronics, the IC 18 or the electric motor 4. In this way, heating of the air taken in is avoided.

Because the air impeller 11 axially crosses the printed circuit board 12, two partial air flows 27 and 28 are produced. The (partial) air flow 27 flows along the upper side 20 of the printed circuit board 12 and is at least partially deflected by the air guiding device 22 by 90° towards the flow through opening 19 lying beneath this on the drawing plane, and so passes directly to the IC 18 disposed on the drawing plane below the printed circuit board 12. Because no electronics are disposed on the upper side 20 of the printed circuit board 12, the partial airflow 27 has hardly warmed up upon reaching the IC 18 and so provides effective cooling of the IC. The (partial) air flow 28 flows along the lower side 13 of the printed circuit board 20 and so cools the electronics attached to the printed circuit board 12.

Figure 3:
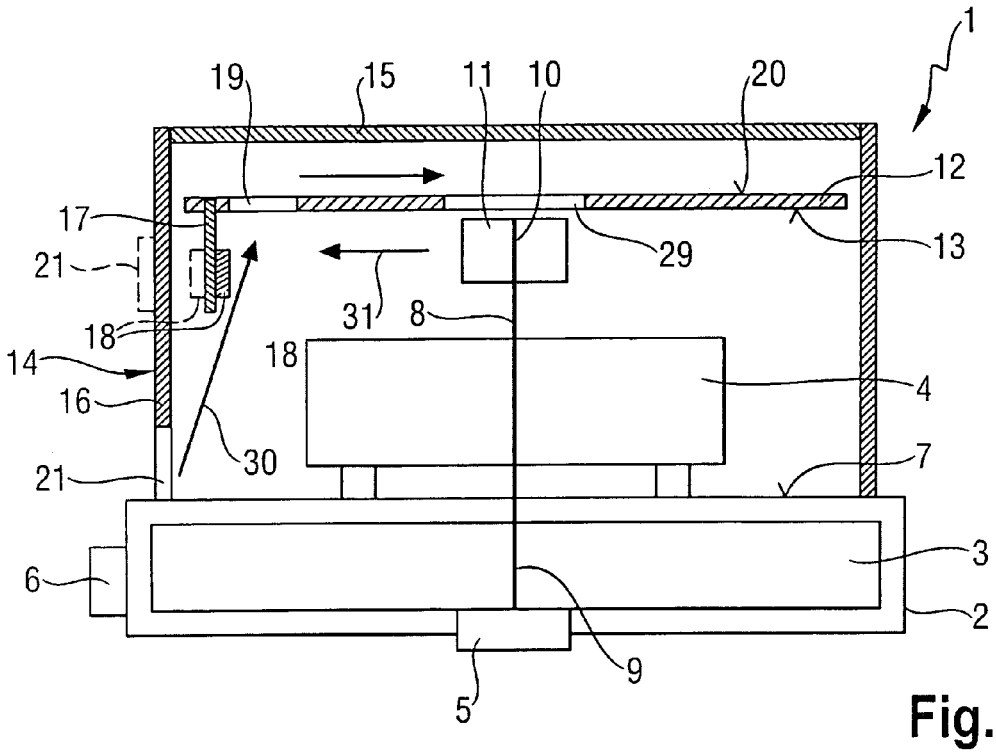
FIG. 3 shows a schematic sectional illustration of a second embodiment of a radial fan according to the invention.

FIG. 3 shows a schematic sectional illustration of a further example of an embodiment of a radial fan 1 according to the invention. The basic structure of the radial fan shown in FIG. 3 corresponds to the previously described structure of the first example of an embodiment. In order to avoid repetition, in the following mainly the differences between the two examples of embodiments will be discussed. Further examples of embodiments are conceivable which can correspond to (partial) combinations of both examples of embodiments.

Figure 4:
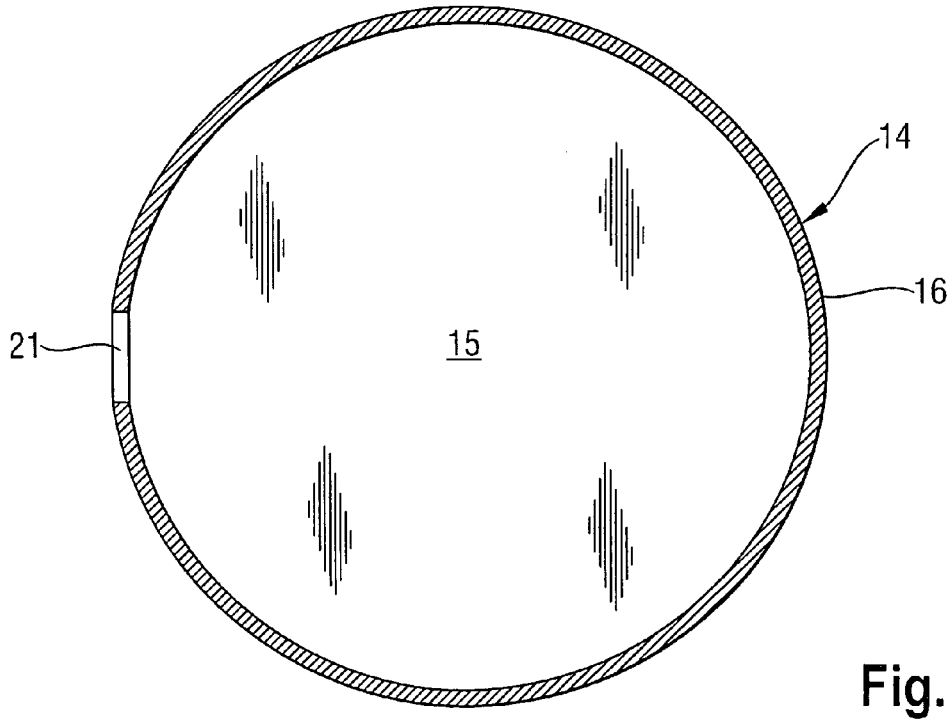
FIG. 4 shows a schematic view of a cap of the fan according to FIG. 3 from below.

In the example of an embodiment of a radial fan 1 shown in FIGS. 3 and 4, the inflow opening 21 for external air is disposed in the peripheral wall 16, directly adjacent to the fan housing 3. In a further, only suggested embodiment, the inflow opening 21 is made directly adjacent to the IC 18 in the peripheral wall 16.

In the example of an embodiment shown, the support 17 holding the IC is disposed at a right angle to the printed circuit board 12 so that the air flowing through the flow through opening 19 also provided flows past the IC. With the second example of an embodiment too, the electronics are disposed exclusively on the lower side 13 of the printed circuit board 12.

An inflow opening 29 for the air impeller 11 is provided in the printed circuit board 12. The air impeller 11 is placed directly on the drawing plane below the inflow opening 29 and, unlike in the first example of an embodiment, does not cross the printed circuit board 12. The air impeller 11 blows off the air taken in through the inflow opening 29 from the upper side 20 of the printed circuit board 12 exclusively below the printed circuit board 12.

In FIG. 4, the cup-shaped cap 14 is shown in a schematic view from below. In the peripheral wall 16 the inflow opening 21 for external air can be seen.

In the following the (partial) air flows in the second example of an embodiment within the cap 14 are described.

The air impeller 11 disposed below the printed circuit board 12 takes in air from the upper side of the printed circuit board 12 through the opening 29. At this point it should be mentioned in addition that the air impeller 11 can of course also cross the printed circuit board 12 in the second example of an embodiment—but it must be ensured that the air impeller 11 only releases the air taken in on the lower side 13 of the printed circuit board 12.

By means of the negative pressure which results from taking in air from the upper side 20 of the printed circuit board 12, air flows from below through the flow through opening 19 in the printed circuit board 12 into the space between the cover 15 and the printed circuit board 12. A large portion of this (partial) airflow identified with reference number 30 passes through the inflow opening 21 into the inside of the cap 14. The external air, which is still cool, flows past the IC 18 on its way towards the flow through opening 19, and cools the same.

The (partial) air flow 31 discharged from the air impeller 11 flows along the lower side 13 of the printed circuit board 12, and so cools the electronics disposed there.

It goes without saying that guiding walls or baffles can be provided which, if so required, prevent mixing of the air flows 30 and 31.

In the figures, a further variation of the radial fan is not shown with which the inflow opening is formed by a peripheral gap between the cap 14 and the fan housing 3. Not shown either is a possible integration of one or more transmissions in the power train between the electric motor 4 and the air impeller 11.

What is claimed is:

1. A radial fan with an electric motor and a printed circuit board with electronics, an air impeller driven by the electric motor for cooling the electronics and with a cap enclosing and protecting the electric motor, said cap having a cover and a peripheral wall, wherein at least one inflow opening is provided on the cap for external air;

an integrated circuit (IC) is disposed on the printed circuit board; and a guiding device is provided for directing an air flow produced by the air impeller to the integrated circuit (IC).

2. The radial fan according to claim 1, wherein the inflow opening is disposed in the cover of the cap.

3. The radial fan according to claim 1, wherein the inflow opening is in the peripheral wall of the cap.

4. The radial fan, in particular with a fan housing, according to claim 1, wherein the inflow opening is in the form of a gap between the cap and the fan housing.

5. The radial fan according to claim 1, wherein the guiding device is integrally formed with the cap.

6. The radial fan according to claim 1, wherein the integrated circuit (IC) is attached to a support on said printed circuit board, positioning said integrated circuit (IC) vertically separate to the level of the printed circuit board in the air flow.

7. The radial fan according to claim 1, wherein the printed circuit board is disposed substantially parallel to the cover.

8. The radial fan according to claim 1, wherein a flow through opening for the air flow is provided in the printed circuit board, the integrated circuit (IC) being disposed adjacent to the opening.

9. The radial fan according to claim 6, wherein the support projects at an angle, in particular of between 90° and 10°, from the printed circuit board.

10. The radial fan according to claim 1, the integrated circuit (IC) is disposed on the lower side of the printed circuit board.

11. The radial fan according to claim 1, wherein the air impeller is a radial cooler fan.

12. The radial fan according to claim 11, wherein the printed circuit board is disposed in relation to the outflow openings of the radial impeller such that part of the cooling air is blown out over the printed circuit board, and part below the printed circuit board.

13. The radial fan according to claim 12, wherein the arrangement of the printed circuit board divides the air flow into substantially equal parts.

14. The radial fan according to claim 1, wherein a recess for the air impeller is provided in the printed circuit board.

15. The radial fan according to claim 1, wherein an inflow opening for the air impeller is formed in the printed circuit board, the air impeller intaking air above the printed circuit board, and blowing out below the printed circuit board.

* * * * *